US006983855B1

(12) United States Patent
Messinger

(10) Patent No.: US 6,983,855 B1
(45) Date of Patent: Jan. 10, 2006

(54) ORGANIZER

(76) Inventor: Samuel J. Messinger, 4812 Pine Tree Dr., #17, Miami Beach, FL (US) 33140

( * ) Notice: Subject to any disclaimer, the term of this patent is extended or adjusted under 35 U.S.C. 154(b) by 542 days.

(21) Appl. No.: 10/268,555

(22) Filed: Oct. 10, 2002

(51) Int. Cl.
*A47F 5/00* (2006.01)

(52) U.S. Cl. ..... 211/135

(58) Field of Classification Search ..... 211/135, 211/73, 42, 43, 40, 50; 248/174; 206/443, 206/485, 590, 592, 593, 814
See application file for complete search history.

(56) References Cited

U.S. PATENT DOCUMENTS

| | | | | | |
|---|---|---|---|---|---|
| 481,505 | A | * | 8/1892 | Muir | 211/42 |
| 1,260,610 | A | * | 3/1918 | Weed | 211/42 |
| 3,013,668 | A | * | 12/1961 | Mennen | 211/40 |
| 3,951,329 | A | | 4/1976 | Turner | 229/23 BT |
| 4,102,525 | A | * | 7/1978 | Albano | 248/174 |
| 4,129,247 | A | | 12/1978 | McCall | 229/36 |
| 4,164,312 | A | | 8/1979 | Harned | 229/15 |
| 4,333,622 | A | | 6/1982 | Albano | 248/188.8 |
| 4,676,383 | A | | 6/1987 | Sheffer | 211/135 |
| 4,886,160 | A | | 12/1989 | Kligerman | 206/44 |
| 5,048,690 | A | | 9/1991 | Zimmerman | 206/602 |
| 5,325,978 | A | | 7/1994 | Rabig | 220/4.24 |
| 5,375,714 | A | | 12/1994 | Burnett | 206/424 |
| 5,379,906 | A | | 1/1995 | Levin et al. | 211/195 |
| 6,244,502 | B1 | | 6/2001 | Hollar et al. | 229/120.011 |
| 6,305,559 | B1 | | 10/2001 | Hardy | 211/184 |
| 6,305,598 | B1 | | 10/2001 | Bryan | 229/120.011 |
| 6,578,717 | B2 | * | 6/2003 | Pickett | 211/42 |

* cited by examiner

*Primary Examiner*—Sarah Purol
(74) *Attorney, Agent, or Firm*—Mintz Levin Cohn Ferris Glovsky and Popeo, P.C.; Ingrid A. Beattie

(57) ABSTRACT

An organizer is formed from a flat sheet of substantially stiff, bendable and deformable corrugated box paper with pre-scored areas to fold and with easily removable perforated areas to custom accommodate the height, width and depth of objects to be placed on a shelf with exposed front portions thereof aligned with the front of the shelf. The perforated areas are preformed as slits or perforations in the flat sheet during a die-cutting operation. Selected sections of panels forming the organizer can be broken away, punched out, or otherwise removed to permit oversize objects, e.g. books, magazines, boxes, cans, articles of folded clothing, or the like to be properly positioned on a shelf or within a box. Use of the organizer enables books, magazines, boxes, cans, articles of folded clothing, and the like to be maintained in position on a shelf and to be positioned to the front of the shelf and in alignment with the front of the shelf for easy location and access by the user. An identically constructed organizer, when inserted in a storage box, either individually or in tandem, can be used to position objects within the box.

24 Claims, 4 Drawing Sheets

ORGANIZER

BACKGROUND OF INVENTION

This invention relates to a device for organizing articles. More specifically, the present invention relates to an organizer for maintaining library books, magazines, boxes, cans, articles of folded clothing, and similar objects of various sizes in a desired position and flush with the very front of the shelf upon which they are being showcased, and that also can be used for organizing objects inside a box.

One of the problems encountered by librarians, library assistants, and library users, store operators, stockers, and store customers is locating a particular object, e.g. book, magazine, box or can, or articles of folded clothing on a filled, crowded shelf. When some of the books, magazines, boxes, cans, and so forth vary widely in size and are of various dimensions, i.e. different height, thickness, and depth, they are not visible to the individual particularly when they are not flush with the very front of the shelf upon which they have been placed. Consumers encounter similar problems when storing clothes, for example, on shelves.

Also, customers or staff who are confined to a wheelchair quite often have an obstructed view of the objects pushed to the rear of the shelf on which they are placed.

A conventional means for overcoming the problem is for the librarian or library assistant, store operator or stocker to simply go around and manually move books, magazines, any boxes or cans, or other objects, which have been pushed to the rear of the shelf, back to the very front of the shelf for clear visibility, easy location, and access thereto by an individual. Such attention and effort is traditionally labor intensive and very repetitive. In the example of library books, books that are of irregular height, depth, and thickness often get shelved out of their Dewey Decimal System order.

Likewise, companies and individuals who ship multiple objects often desire to position those objects within a box or packing crate in a manner that avoids unrestrained movement. Conventional packing materials for that purpose typically are specifically manufactured to custom-fit the objects. In such cases, the shipper must ensure that an adequate supply of custom-fitted containers are available, and cannot easily pack different products using the same containers. Alternatively, loose materials such as packing peanuts, shredding, and the like can be employed, but such loose materials do not entirely prevent movement of the product, are clumsy to insert, and are unpopular with recipients who must dig through loose materials to remove them.

The following patents are illustrative of devices that aid in the positioning and storing of various types and sizes of articles.

U.S. Pat. No. 5,375,714 is for a "DEVICE TO MAINTAIN VERTICAL POSITION OF COMIC BOOKS AND MAGAZINES DURING STORAGE" and issued to Randy B. Burnett on Dec. 27, 1994. This storage box receives paper articles on their ends extending in a vertical position and incorporates a filler to maintain the paper articles, e.g. comic books, on their ends extending in a vertical position.

U.S. Pat. No. 5,325,978 is for a "NESTING MAGAZINE ORGANIZER" and issued Jul. 5, 1994 to Donald B. Rabig. This patent provides a nesting magazine organizer in which two containers can be interfitted in a friction fitting relation for compact and easy shipping.

U.S. Pat. No. 4,129,247 is for a "DIE-CUT CARTON WITH BUILT-IN FILLERS" and issued Dec. 12, 1978 to Richard J. McCall. This patent utilizes a sheet of corrugated material die-cut and scored into a one-piece blank formable into a closed carton for book shipping having integral corner fillers which are formed and strategically located automatically upon erection for the walls of the box.

U.S. Pat. No. 3,951,329 is for a "TELESCOPE CONTAINER WITH RECESSED ENDS" and issued Apr. 20, 1976 to Gerald W. Turner. This patent provides a sheet of paperboard cut and scored to be folded into a container. It is formed as a pair of trays operating in telescoping relationship.

With the above in mind, it is an object of the present invention to provide an organizer that is simple and economical to manufacture.

It is an object of the present invention to provide a universal organizer that can be configured for use on various shelf sizes with various height, thickness, and depth of articles thereon, e.g. books, magazines, articles of folded clothing, boxes or cans.

A further object of the present invention is to provide an organizer that is formed from a single, flat sheet of corrugated box paper.

A further object of the present invention is to provide an organizer that can be configured to retain different sizes of articles in position in boxes for storage, including storage during shipping.

Other objects and advantages of the invention will be more fully apparent from the following disclosure and appended claims.

SUMMARY OF INVENTION

The present invention is directed to an organizer and specifically to an organizer for objects, e.g. library books, magazines, boxed goods, paint cans, articles of folded clothing, and the like, that is made from a substantially stiff but deformable and bendable flat, blank sheet of material such as corrugated box paper with pre-compressed fold lines and perforated areas perpendicular to the fold lines to custom fit the variation in size (e.g. width and height) of the objects. Utilizing the invention organizer, for example, a librarian or library assistant is able to place library books, magazines, and the like upright on the library bookshelves and positioned with the spines thereof to the very front and maintain the same there for easy location and access by the user. Of particular importance, use of the organizer of the invention as a shelf organizer is extremely helpful to those library visitors or workers who are in a wheelchair since they almost always have an obstructed view when the books are pushed all the way to the rear of the shelf. Such would also be the case for wheelchair bound customers in a grocery store environment where boxed and canned goods are often also pushed to the rear of the shelf on which they are stocked.

The organizer also can be used individually or in multiples, to position objects within boxes for storage and shipping.

The present invention and its features and advantages will be more fully understood, and further features and advantages will become apparent, when reference is made to the following detailed description, drawings and claims of the invention.

DETAILED DESCRIPTION

While the preferred embodiment of the present invention is described herein, it should be recognized that further embodiments of the invention might be of such dimensions and configurations so as to be suited for storing numerous objects other than those described. Referring to FIGS. 1–8, wherein like numerals indicate like elements, there is shown, a preferred embodiment of the invention organizer 10, as a representative example, for library books, magazines, and the like.

Figure 1:
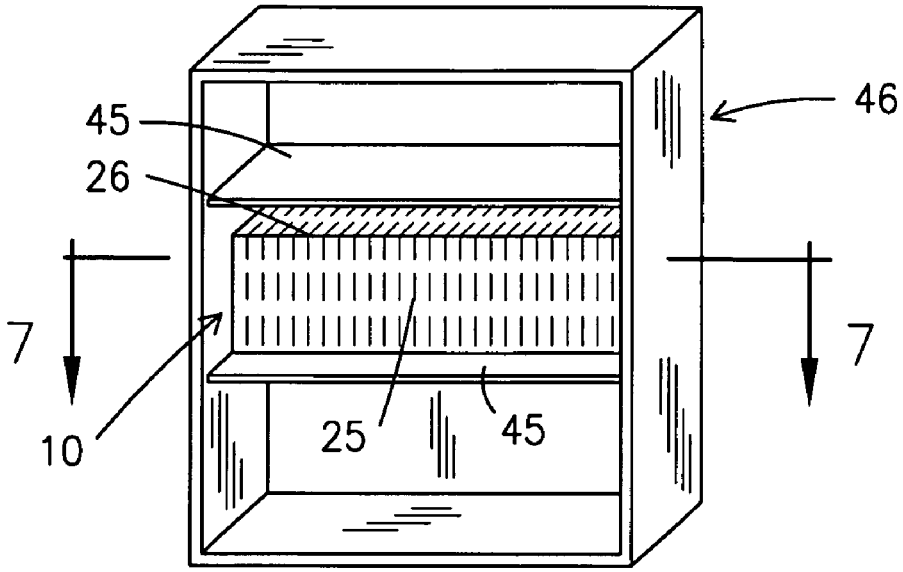
FIG. 1 is a pictorial view showing an assembled organizer according to the present invention ready for use on a library bookshelf.
Figure 2:
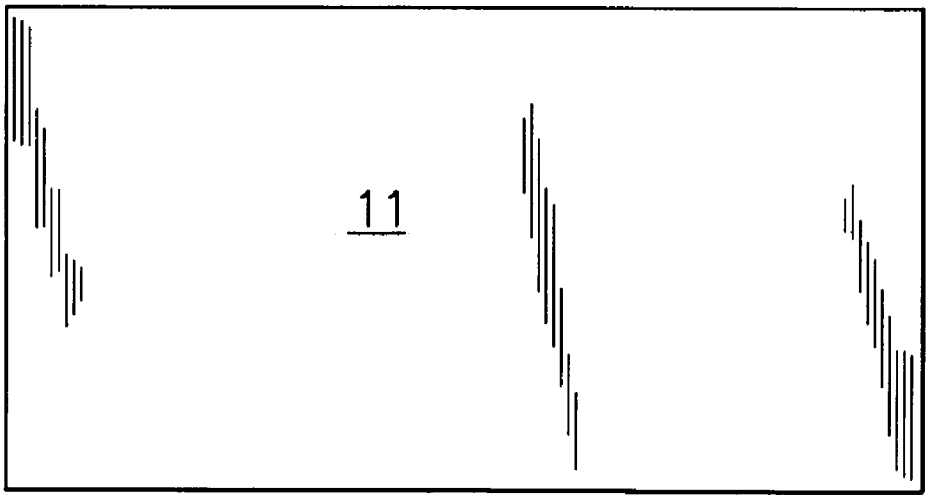
FIG. 2 is a top plan view of a flat substantially stiff but deformable and bendable blank sheet of corrugated box paper from which the invention organizer is formed.

While organizer 10 could be made from a single ply cardboard, plastic, or other suitable material, it is preferably made from substantially stiff but deformable and bendable corrugated box paper of a grade similar to that used for "banker's boxes" or similar precut cardboard filing boxes such as used in law-firms around the country. Organizer 10 is preferably formed, by a die-cutting operation, from a flat, stiff, unitary rectangular shaped sheet 11 of corrugated load-bearing box paper (FIG. 2).

Die-cut blank 12 (FIG. 3) is the resulting product of the die cutting operation. A plurality of longitudinal fold lines 13 through 22 are pre-compressed into blank 12. Blank 12 is also formed, in the die-cutting operation, with defined panels 25, 26, 27 and 28. Also, a closure tab 30 is formed on the outside edge of panel 25. Slots 33, 34 and 35 are formed on the outside edge of panel 28 during the die cutting operation. Tab 30 has angled tab ends 31, 32 formed during the die cutting operation to aid entry of closure tab 30 into a selected one of slots 33, 34 or 35 so as to permit some adjustment in size of the assembled organizer 10.

Perpendicular to the fold lines are slits or perforations 40 that define lines along which selected portions of panels 25, 26, 27 and 28 can be easily broken and are designed to allow removal of such selected portions of panels 25, 26, 27 and 28 when organizer 10 is in use as later discussed in the description. Once the die-cutting operation is carried out and the pre-compressed fold lines 13 through 22 are formed, blank 12 is ready for assembly into organizer 10 as in FIG. 5. Once folded and assembled, organizer 10 becomes the resulting product.

Figure 3:
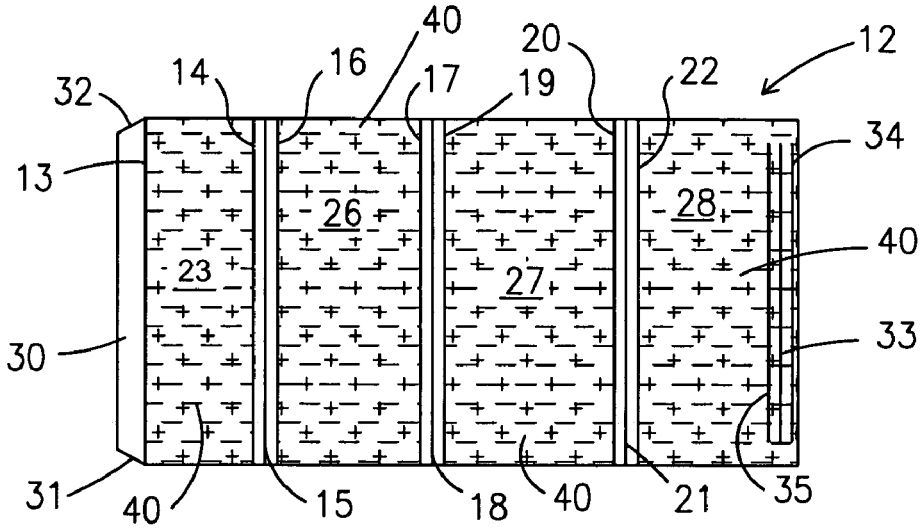
FIG. 3 is a top plan view of the blank sheet of FIG. 2 after having been through a die-cutting operation during which pre-compressed fold score lines and pre-perforated punch out sections, from which the organizer of the invention is formed, are impressed into the flat corrugated box paper sheet.
Figure 4:
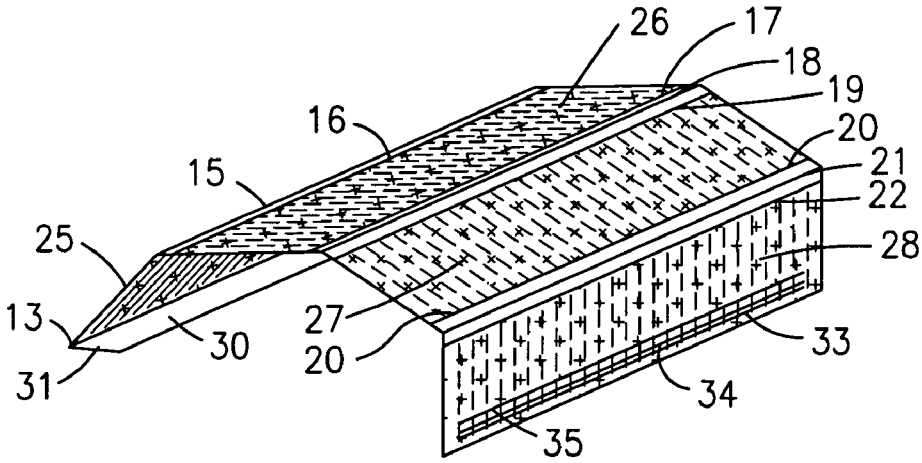
FIG. 4 is a perspective view of the invention organizer with the organizer in a partially bent and folded form.
Figure 5:
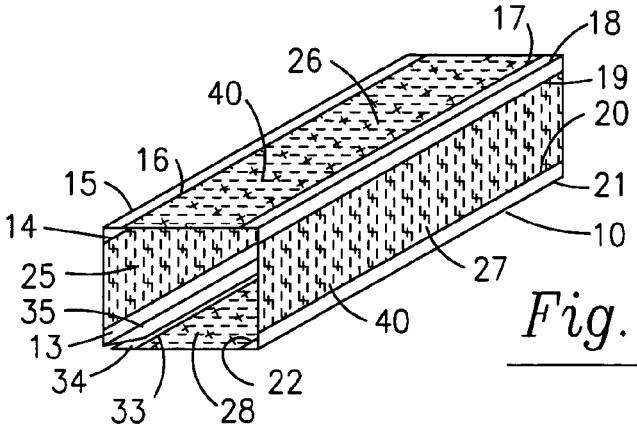
FIG. 5 is a perspective view of the invention organizer with the organizer in a completely folded and assembled form.

Referring now specifically to FIGS. 3, 4 and 5, it will be seen that panels 25, 26, 27 and 28 seen in FIG. 3 are initially folded into the position of FIG. 4. Next, as can be seen in FIG. 5, organizer 10 is completely folded and assembled once closure tab 30 has been folded over and inserted into a predetermined slot 33, 34 or 35.

A glue material can be placed between closure tab 30 and panel 28 where it extends from the selected slot 33, 34 or 35. However, closure tab 30 and the selected slot hold shelf organizer 10 together without the necessity of glue whenever it is desirable to disassemble organizer 10 after an initial use and store the same for reuse at a later time.

FIG. 5 illustrates the formed organizer 10, after the closing operation has been completed. At this point, organizer 10 is ready for use and can be placed, for example, on a bookshelf 45 of a bookcase 46 (see FIGS. 1, 6 and 7), or in a box 51 (See FIG. 8).

As a representative example, once organizer 10 is assembled and is in place on a conventional library bookshelf 45 of bookcase 46 and pushed to the rear of bookcase 46 so that it resides against the back wall thereof (see FIG. 1), bookcase 46 is now ready to receive books 50 which may be placed onto shelf 45 by the librarian or library assistant. All books 50 placed on shelf 45 against organizer 10 are preferably stored with their spine facing outward and their titles facing in the same direction. Organizer 10 enables books 50 to be stored with their respective outer spine surfaces aligned flush with the front of shelf 45 of bookcase 46 which allows unobstructed visibility and tends to constantly "showcase" books 50, regardless of their depth.

Figure 6:
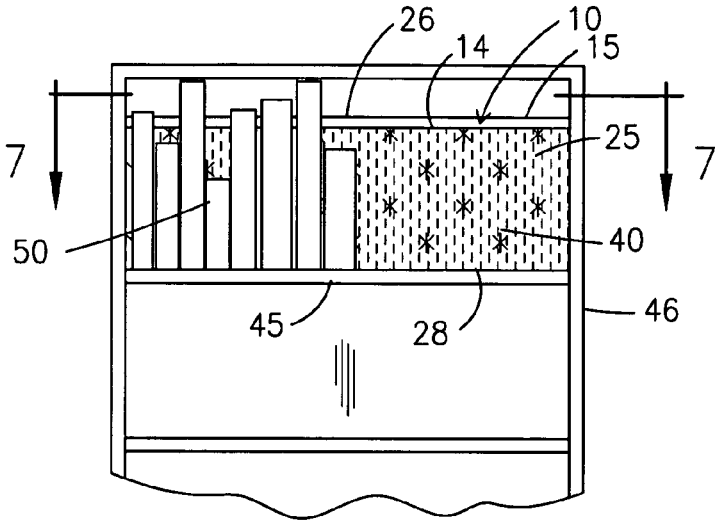
FIG. 6 is a fragmentary front elevation view of the invention organizer with the organizer in use on a bookshelf and with books of various sizes situated on a shelf of the bookcase.
Figure 7:
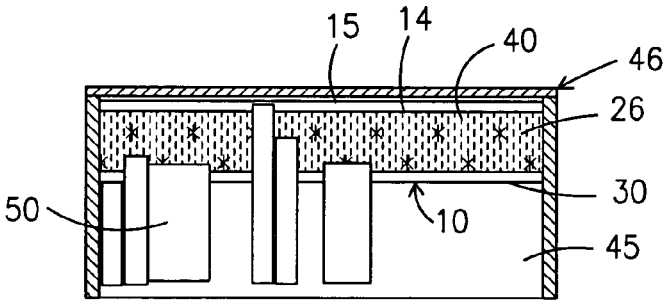
FIG. 7 is a section view taken substantially along line 7—7 of FIG. 1 and illustrating how the invention organizer accommodates, as a representative example, library books of different size.

As best seen in FIGS. 6 and 7, a collection of books 50 by way of example, although boxes, cans, articles of folded clothing, etc. could be the objects being organized, of various sizes, thickness and depth have been placed on shelf 45 and against organizer 10 while supported on shelf 45 of bookcase 46. As can be best seen in FIG. 7, when a book 50 of greater depth than the distance between the front of organizer 10 and the front of the shelf is to be placed on shelf 45, a section of selected panels 25 and 26 of organizer 10 is broken or punched out along slits 40 and a book 50 is allowed to extend beyond panel 25 and into organizer 10 far enough to allow book 50 to reside on shelf 45 with its spine flush with the other books 50 and the front of shelf 45. All other books 50 still remain neatly arranged and flush with the front of shelf 45 regardless of their depth. Also, if a wide book needs to be placed on shelf 45 in bookcase 46, more than one section of panels 25 and 26 may be broken out along slits 40. Several slots adjacent each other may be removed when necessary to make room for an exceptionally large size volume. Any book not requiring adjustment because of width or depth will either rest flush with organizer 10 or have a gap between organizer 10 and the book but in any event is retained sufficiently fixed in place to accomplish the desired purpose. As seen in FIG. 7, since the organizer is adjustable, this gap is insignificant and does not materially detract from proper order and viewing.

While not illustrated, it is anticipated that slits or perforations perpendicular to slits or perforations 40 could also be pre-formed in panels 25, 26, 27 and 28 of blank 12 during the die-cutting operation. The slits or perforations perpendicular to slits 40 would provide other means along which panels 25, 26, 27 and 28 could be broken and thus allow for only a selected portion of panels 25, 26 to be punched out or otherwise removed. Thus, a short-width but relatively long book could be placed on shelf 45 and organizer 10 will accommodate the increased length through the removal of 1 or more adjacent panels 25, 26. Thus, the organizer accommodates books of varying sizes.

The overall size of organizer 10 is adjustable by utilizing tab 30 and inserting into slots 33, 34 or 35 to custom-fit the organizer into a free-standing stable structure. If tab 30 is to be inserted into slot 33, panels 25, 26, 27 and 28 should be folded along fold lines 16, 19 and 22. Thus one size of organizer 10 is formed. If tab 30 is placed in slit 34, as shown, panels 25, 26, 27 and 28 are folded along lines 15, 18 and 21 thus providing an organizer of the size shown in FIG. 5. If tab 30 is folded and inserted into slit 35, then panels 25, 26, 27 and 28 are folded along lines 14, 17 and 20, so that still another size organizer 10 is provided.

Figure 8:
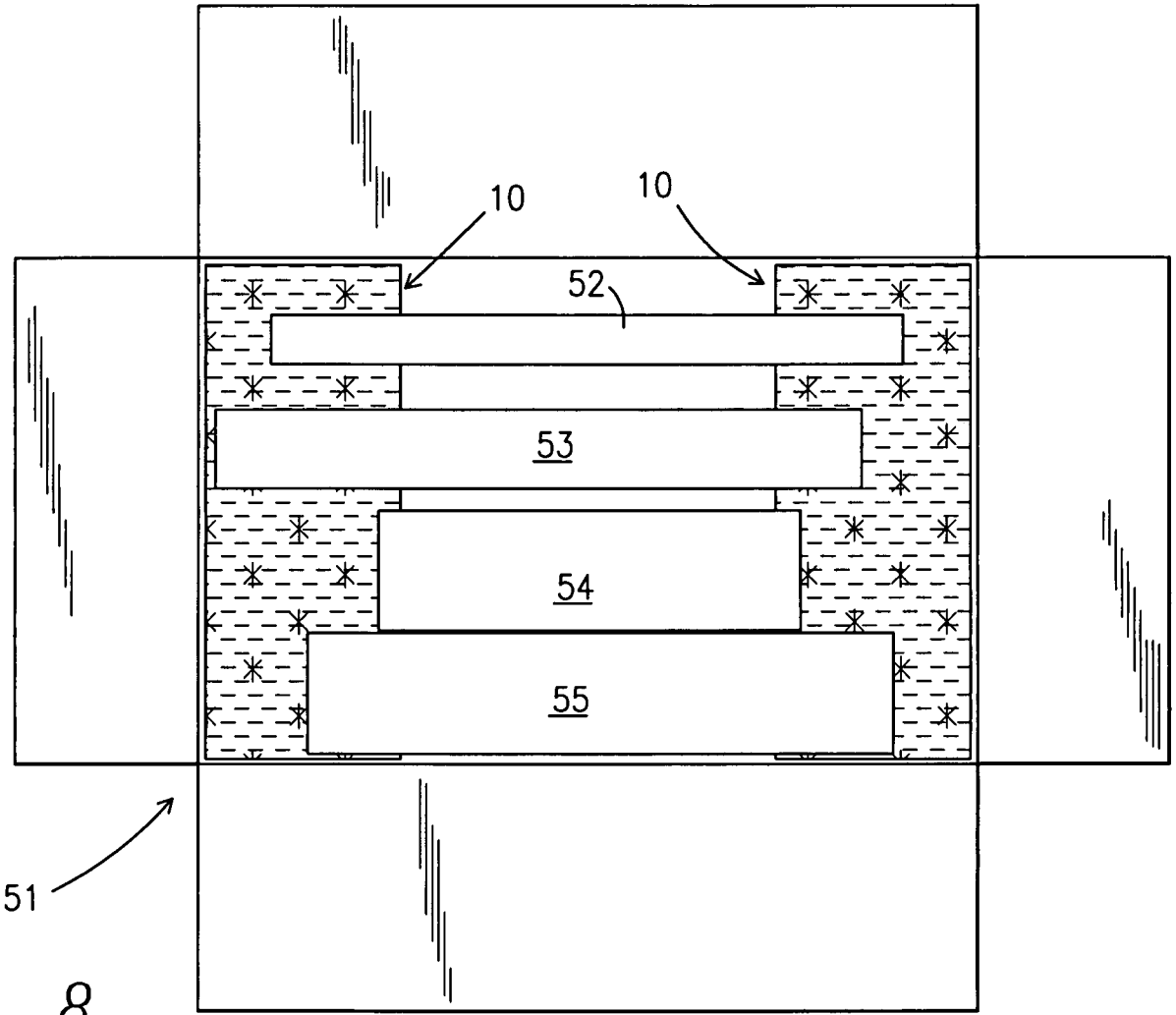
FIG. 8 is a plan view of a packing box containing objects of various sizes retained in place by two of the invention organizers.

Referring now specifically to FIG. 8, it will be seen that organizer 10 may also be positioned inside a storage box 51 to enable objects of various sizes and shapes 52, 53, 54 and 55 to be stored compactly and substantially fixedly positioned inside box 51. While some movement of the stored objects may occur, it would not be sufficient to endanger their safe storage and shipment.

From the above description, it should be readily apparent that numerous changes and modifications could be made without departing from the spirit and scope of the invention.

What is claimed is:

1. An organizer for use with shelving for storing objects such as books, magazines, boxes, cans, articles of folded clothing, or the like, comprising:

(a) a unitary, one-piece substantially stiff, bendable and deformable, rectangular blank formed from a flat sheet of material having a thickness;

(b) fold lines formed in said blank; and (c) perforated areas removable formed in said blank, said one piece blank being foldable along said fold lines into said organizer for holding and displaying various objects including objects having portions received in holes formed by removal of said perforated areas and which when stored have at least one portion thereof which is aligned with the front of a shelf on which said objects are stored.

2. An organizer as claimed in claim 1 wherein said fold lines and said perforated areas are pre-compressed into said blank during the forming of said blank.

3. An organizer as claimed in claim 1 wherein said forming of said blank from said flat sheet of material is achieved by a die-cutting operation.

4. An organizer as claimed in claim 1 wherein said perforated areas are defined by slits penetrating said blank.

5. An organizer as claimed in claim 1 wherein said organizer is formed from a corrugated type box paper.

6. An organizer as claimed in claim 2 wherein selected ones of said pre-compressed perforated areas are adapted to be manually broken out of said organizer.

7. An organizer as claimed in claim 4 wherein said slits are formed parallel with opposite ends of said blank.

8. An organizer as claimed in claim 4 wherein said slits are formed parallel both to opposite sides and opposite ends of said blank.

9. An organizer as claimed in claim 5 wherein said corrugated type box paper comprises a single sheet of stiff load bearing type paper.

10. An organizer for use with shelving for storing library books, magazines, boxes, cans, articles of folded clothing, or the like, comprising a unitary, one-piece blank formed from a flat, stiff sheet of material formable into said organizer for holding and displaying various objects which when stored have at least one portion which is preferably aligned with the shelf front on which the objects are stored, including:

(a) fold lines formed in said blank and defining panels which can be bent along said fold lines to form said one-piece blank into said organizer; and (b) perforated areas formed in selected panels of said blank, said perforated areas being selectively removable in sections so as to allow objects of various heights, widths and depths to pass therethrough to permit exposed surfaces of said object to reside flush with the front of said shelf.

11. An organizer as claimed in claim 10 wherein said blank from which said organizer is formed includes integral tabs, said tabs being foldable and insertable into an open portion of said blank to hold the said organizer formed from said blank together.

12. An organizer as claimed in claim 11 wherein said open portion of said blank into which said tab is insertable is in the form of a die-cut slot formed in said blank.

13. An organizer for use in retaining objects in a desired position comprising:

(a) a unitary, one-piece substantially stiff, bendable and deformable, rectangular blank formed from a flat sheet of material having a thickness;

(b) fold lines formed in said blank; and (c) perforated areas which are removable formed in said blank, said one piece blank being foldable along said fold lines into said organizer for holding and positioning various differently-sized objects including objects having portions received in holes formed by removal of said perforated areas.

14. An organizer as claimed in claim 13 wherein said fold lines and said perforated areas are pre-compressed into said blank during the forming of said blank.

15. An organizer as claimed in claim 13 wherein said forming of said blank from said flat sheet of material is achieved by a die-cutting operation.

16. An organizer as claimed in claim 13 wherein said perforated areas are defined by slits penetrating said blank.

17. An organizer as claimed in claim 13 wherein said organizer is formed from a corrugated type box paper.

18. An organizer as claimed in claim 14 wherein selected ones of said pre-compressed perforated areas are adapted to be manually broken out of said organizer.

19. An organizer as claimed in claim 16 wherein said slits are formed parallel with opposite ends of said blank.

20. An organizer as claimed in claim 16 wherein said slits are formed parallel both to opposite sides and opposite ends of said blank.

21. An organizer as claimed in claim 17 wherein said corrugated type box paper comprises a single sheet of stiff load bearing type paper.

22. An organizer for use in retaining objects in a desired position comprising a unitary, one-piece blank formed from a flat, stiff, sheet of material formable into said organizer for holding and positioning various objects, including:

(a) fold lines formed in said blank and defining panels which can be bent along said fold lines to form said one-piece blank into said box organizer; and (b) perforated areas formed in selected panels of said blank, said perforated areas being selectively removable in sections so as to allow objects of various heights, widths and depths to pass therethrough to permit said object to reside substantially fixedly in the desired location.

23. An organizer as claimed in claim 22 wherein said blank from which said organizer is formed includes integral tabs, said tabs being foldable and insertable into an open portion of said blank to hold the said organizer formed from said blank together.

24. An organizer as claimed in claim 23 wherein said open portion of said blank into which said tab is insertable is in the form of a die-cut slot formed in said blank.

* * * * *